United States Patent [19]

Watanabe

[11] Patent Number: 4,642,457

[45] Date of Patent: Feb. 10, 1987

[54] DOUBLE SHEET DETECTION METHOD AND APPARATUS OF SHEET-FED ROTARY PRESS

[75] Inventor: Hideo Watanabe, Chiba, Japan

[73] Assignee: Komori Printing Machinery Co., Ltd., Tokyo, Japan

[21] Appl. No.: 574,879

[22] Filed: Jan. 30, 1984

[51] Int. Cl.[4] ..... G01N 9/04

[52] U.S. Cl. ..... 250/223 R; 356/434

[58] Field of Search ..... 250/223 R, 562, 563, 250/571, 572, 223 B; 356/443, 444, 434; 222/415, 371

[56] References Cited

U.S. PATENT DOCUMENTS 3,614,419 10/1971 Daughton et al. ..... 250/223 R 4,237,378 12/1980 Jones ..... 356/434

*Primary Examiner*—David C. Nelms

*Attorney, Agent, or Firm*—Blakely, Sokoloff, Taylor & Zafman

[57] ABSTRACT

Double sheet detection method and apparatus of a sheet-fed rotary press, wherein a theoretical reference value is set as an intermediate value between a first theoretical amount of light transmitted through one sheet and a second theoretical amount of light transmitted through two sheets, respectively; the theoretical reference value is subtracted from the first amount of light to obtain a theoretical subtracted value; the theoretical subtracted value is subtracted from an actual amount of light transmitted through one sheet to obtain an actual reference value; and an actual amount of light transmitted through a current sheet is compared with the actual reference value to perform double sheet detection.

8 Claims, 10 Drawing Figures

DOUBLE SHEET DETECTION METHOD AND APPARATUS OF SHEET-FED ROTARY PRESS

BACKGROUND OF THE INVENTION

The present invention relates to double sheet detection method and apparatus of a sheet-fed rotary press.

In conventional sheet-fed rotary presses, when two sheets are simultaneously fed to a feedboard, they are detected through a through hole of the feedboard by a photodetector consisting of a light source and a photosensor so as to stop the operation of the press. Conventional detecting methods are shown in FIGS. 1 to 3, respectively.

FIGS. 1 to 3 are graphs each of which shows the relationship between a transmittance $\alpha$ of light through a sheet and an amount D of transmitted light therethrough. It should be noted that the amount of light is expressed in percentage under the assumption that an amount of light which corresponds to 100% of transmittance is given to be 100%. The transmittance $\alpha$ and the amount D have a linear relationship ($D=\alpha$) when one sheet is subjected to detection, as indicated by a line A. However, the transmittance $\alpha$ and the amount D have a nonlinear relationship ($D=\alpha^2$) when two sheets are subjected to detection. When the sheets have the same quality and thickness, the amount of light transmitted through one sheet is greater than that transmitted through two sheets. Double sheet detection is performed in accordance with a difference between these amounts.

According to the method shown in FIG. 1, a detection level Ld is fixed in accordance with the types (thickness and quality) of sheets. In other words, each detection level is given for the corresponding type of sheet. A detectable range DE of this method is very narrow, and the detection level must be reset in accordance with each different type of sheets. In addition to these disadvantages, changes in various conditions over time cannot be compensated by this method.

In the method shown in FIG. 2, the previous amounts of light transmitted through the given type of sheets are averaged. Data representing an average amount of light is stored in a memory, and a detection level Ld is determined in accordance with this data. In comparison with the method shown in FIG. 1, a detectable range DE of the second method can be greatly increased. However, when a transmittance becomes close to 0% and 100%, double sheet detection cannot be performed.

In the method shown in FIG. 3, a detection level Ld is determined by multiplying a given ratio with the data stored in the second method. A detectable range DE of the third method is wider than that of the second method. However, when a transmittance becomes close to 100%, double sheet detection cannot be performed.

SUMMARY OF THE INVENTION

It is an object of the present invention to provide a double sheet detection method wherein double sheet detection can be performed in accordance with an optimal reference value which can be automatically set even if a transmittance substantially varies from 0% to 100%.

It is another object of the present invention to provide a double sheet detecting apparatus using the above method.

According to an aspect of the present invention, there is provided a double sheet detection method used in a sheet-fed rotary press, comprising the steps of:

setting a theoretical reference value as an intermediate value between a first theoretical amount of light transmitted through one sheet and a second theoretical amount of light transmitted through two sheets, respectively;

subtracting the theoretical reference value from the first amount of light to obtain a theoretical subtracted value;

subtracting the theoretical subtracted value from an actual amount of light transmitted through one sheet to obtain an actual reference value; and comparing an actual amount of light transmitted through a current sheet with the actual reference value to perform double sheet detection.

According to another aspect of the present invention, there is provided a double sheet detection apparatus of a sheet-fed rotary press, comprising:

a light-emitting element and a light-receiving element for generating an analog signal representing an amount of light received;

a processing section for receiving the analog signal from the light-receiving element and converting the analog signal into a digital signal;

a subtracted value generator for generating a first subtracted value;

an operation circuit for receiving the digital signal from the processing section and the first subtracted value from the subtracted value generator and subtracting the first subtracted value from the digital signal to produce a second subtracted value;

a memory for receiving and storing the second subtracted value;

a comparator for receiving the digital signal from the processing section and the second subtracted value from the memory and comparing the digital signal with the second subtracted value; and an output circuit for receiving and gating as a double sheet detection output an output from the comparator.

According to the present invention, the optimal reference value for double sheet detection can be automatically set in consideration of changes in detection conditions. Therefore, influences by a change in transmittance of a sheet and a change in various conditions over time can be eliminated, thereby always allowing proper double sheet detection.

DESCRIPTION OF THE PREFERRED EMBODIMENT

In order to best understand the present invention, the principle of double sheet detection according to the present invention will be described with reference to FIG. 4.

Figure 2:
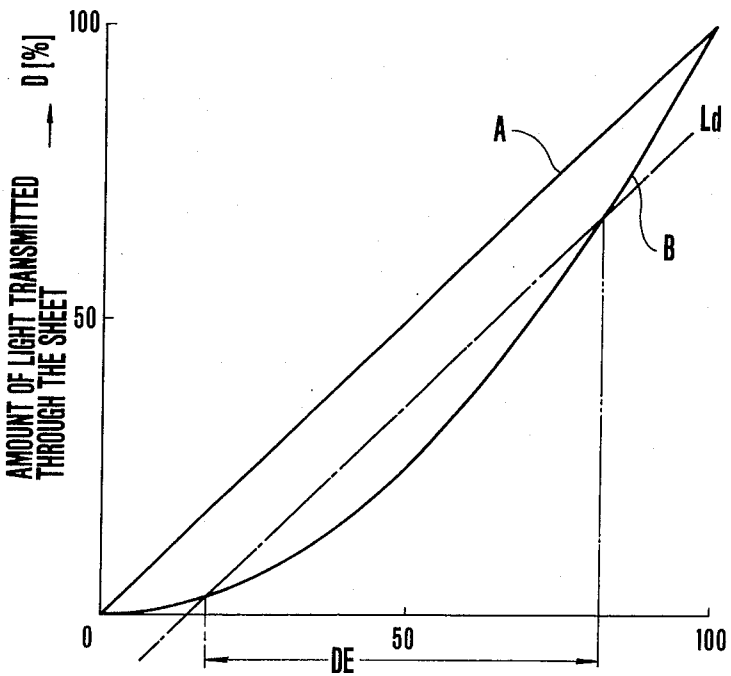
FIG. 2 PRIOR ART
FIGS. 1, 2 and 3 are graphs showing the principles of double sheet detection according to conventional methods, respectively.
Figure 1:
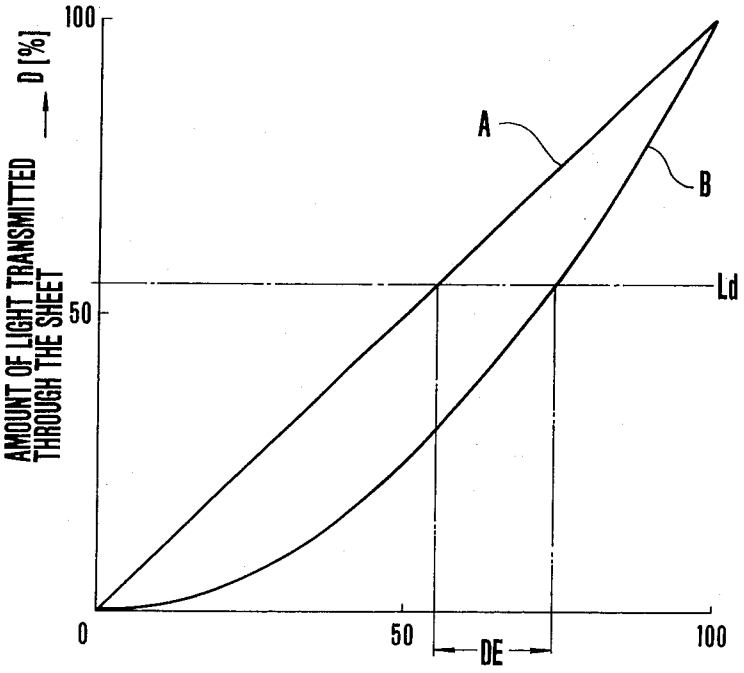
FIG. 1 PRIOR ART
Figure 4:
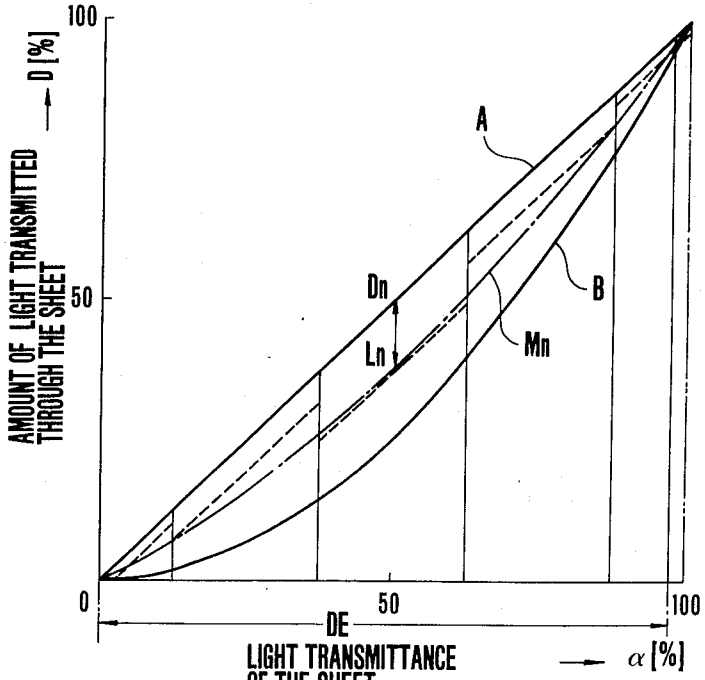
FIGS. 4 and 5 are respectively graphs for explaining the principle of double sheet detection according to the present invention.
Figure 3:
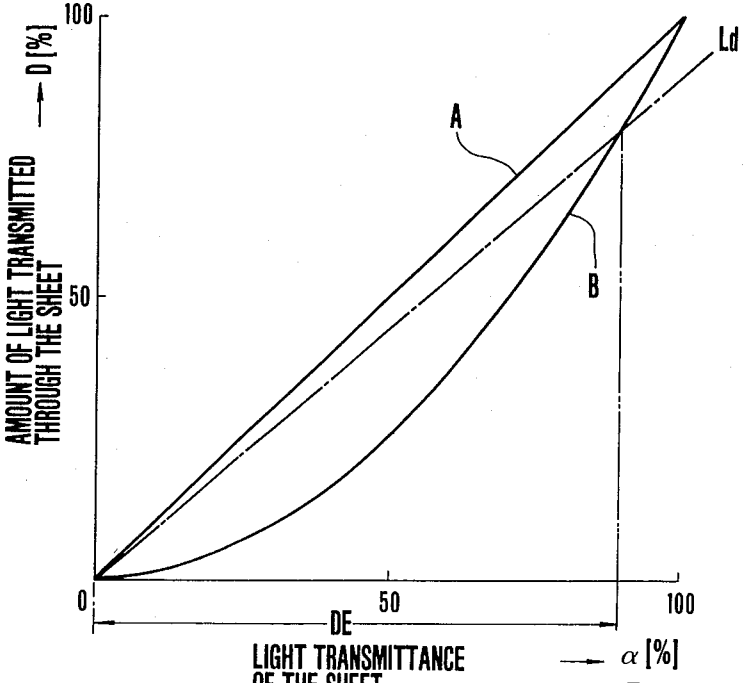
FIG.3 PRIOR ART

FIG. 4 shows the relationship between a transmittance $\alpha$ of light through a sheet and an amount D of light tansmitted through the sheet in the same manner as in FIGS. 1 to 3. It should be noted again that the amount of light is expressed in percentage under the assumption that an amount of light which corresponds to 100% of transmittance is given to be 100%.

Referring to FIG. 4, a curve representing an intermediate value between a theoretical amount D (represented by a line A) of light transmitted through one sheet and a theoretical amount D (represented by a curve B) of light transmitted through two sheets is given to be $D=\alpha-(\alpha-\alpha^2)/2$. The intermediate value is defined as a reference value Mn. The reference value Mn is subtracted from the value corresponding to the theoretical amount D of light transmitted through one sheet to obtain a theoretical subtracted value Ln. The subtracted value Ln is subtracted from actual amount Dn of light transmitted through sheets of a given type to obtain an actual reference value Mn. The actual reference value Mn defines an actual detection level Ld which is used to perform double sheet detection of the sheets of the given type.

In other words, the theoretical subtracted value Ln is preset in accordance with the corresponding amount D of light. A calculation given by $Dn-Ln=Mn$ is repeatedly performed to obtain the actual reference value Mn. An amount $Dn+1$ of currently transmitted light is compared with the corresponding actual reference value. When a condition $Mn \geqq Dn+1$ is established, a double sheet detection apparatus can detect that two sheets of the given type are simultaneously fed. Therefore, a detectable range DE can be widened so as to substantially correspond to the transmittance range from 0% to 100%.

As indicated by dotted lines, the actual reference values can be approximated by straight lines in accordance with regions of the detectable range so as to obtain the same result as described above.

Figure 5:
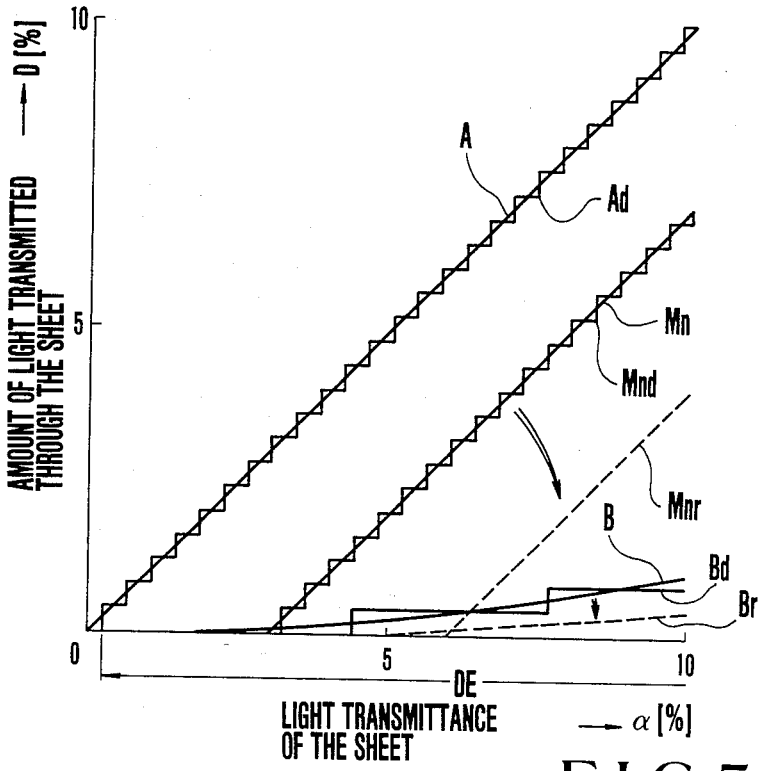

FIG. 5 is a graph showing a low transmittance range in an enlarged manner. When the sheet has a low transmittance $\alpha$, overlying sheets are detected to have a lower value (indicated by a curve Br) than a theoretical value (indicated by a curve B) due to light reflection between the overlying sheets. Therefore, the actual reference value must change from Mn to Mnr when the sheet has a low transmittance. A subtracted value Ln is preferably determined in accordance with the value Mnr.

It should be noted that reference symbols Ad, Mnd, Bd and so on in FIG. 5 are quantized data.

Figure 6:
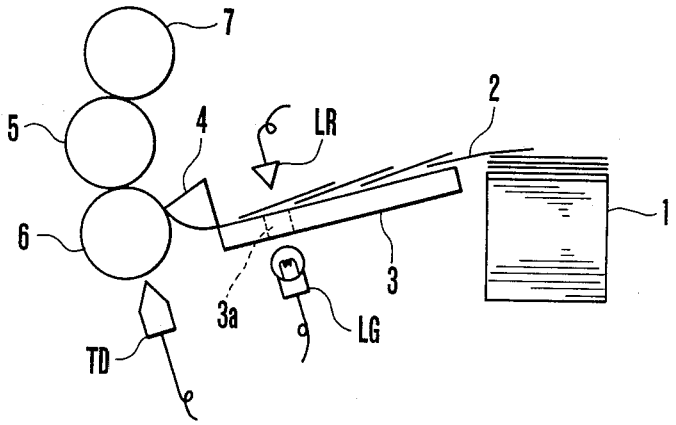
FIG. 6 is a block diagram showing the overall construction of a sheet-fed rotary press to which the present invention is applied.

FIGS. 6 to 10 show an embodiment of the invention which is based on the principle described above. FIG. 6 shows a schematic configuration of a sheet-fed rotary press to which the present invention is applied. A sheet 2 is fed from a feeding table 1 to a feedboard 3. The leading end of the sheet 2 is gripped by grippers 4, and the sheet 2 is fed between a blanket cylinder 5 and an impression cylinder 6. An image transferred from a plate cylinder 7 to the blanket cylinder 5 is printed on the sheet 2. A through hole 3a is formed in the vicinity of the distal end of the feedboard 3. Light emitted from a light source LG disposed below the lower surface of the feedboard 3 passes through the sheet 2. Light transmitted through the sheet 2 is received by a photosensor LR. The light received by the photosensor LR is converted into an electrical signal.

Drive members such as projections (not shown) are formed on the surface of the impression cylinder 6. A detector TD such as a proximity switch is arranged to oppose the impression cylinder 6 and detects rotation of the impression cylinder 6. The detector TD generates a pulse signal in synchronism with rotation of the impression cylinder and hence operation of the rotary press.

Figure 7:
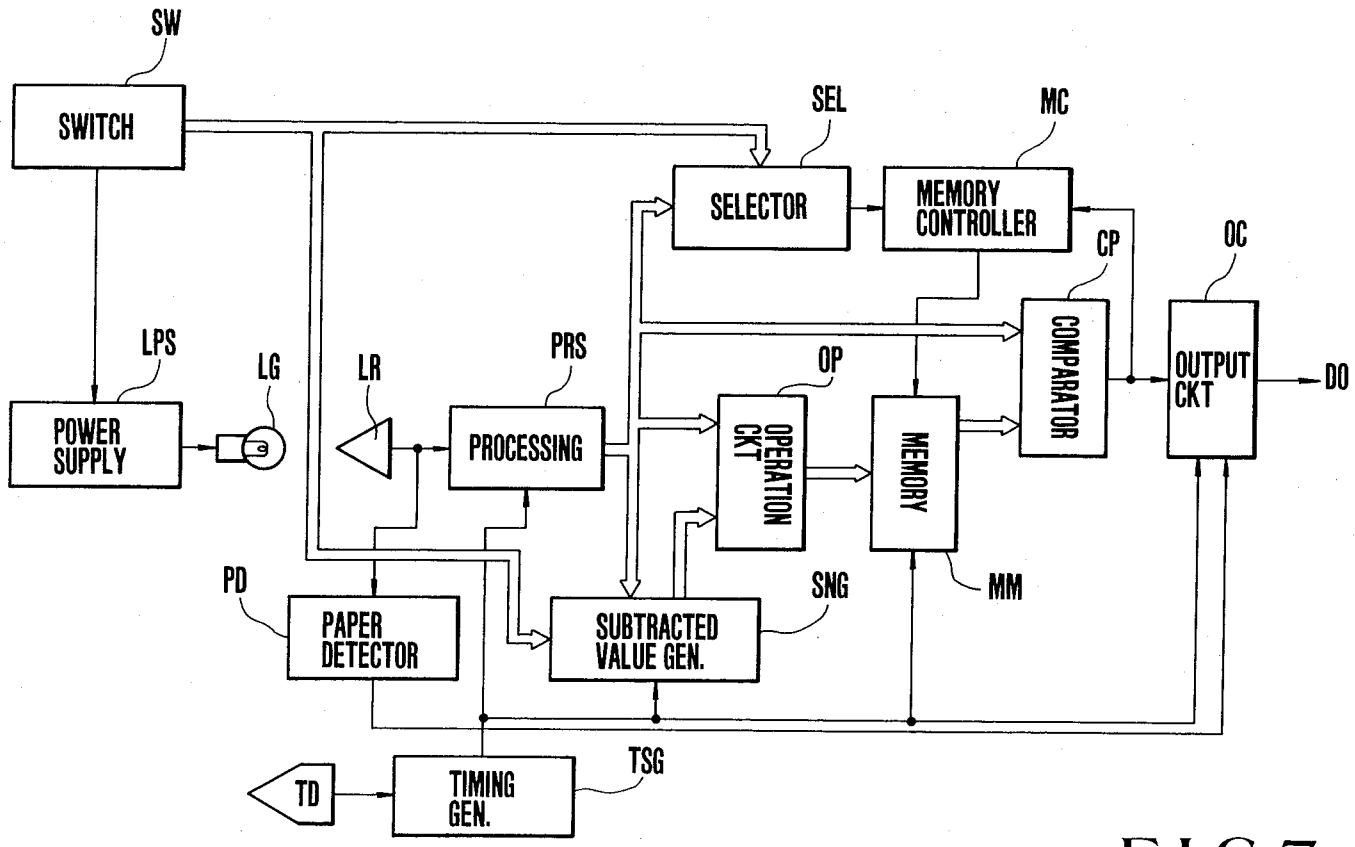
FIG. 7 is a block diagram of a double sheet detection apparatus according to an embodiment of the present invention.

FIG. 7 is a block diagram of a double sheet detection apparatus used for the sheet-fed rotary press described above.

The light source LG is turned on by a power supply LPS, and an output from the photosensor LR is supplied to a processing section PRS and is converted to a digital signal. This digital signal is supplied to a selector SEL, a comparator CP, an operation circuit OP, and a subtracted value generator SNG. The selector SEL, the operation circuit OP and the subtracted value generator SNG include a decoder, a subtractor, and a memory, respectively.

The operation circuit OP subtracts an output of the subtracted value generator SNG from an output of the processing section PRS. A subtracted result or difference is supplied from the operation circuit OP to a memory MM such as a latch. A storage content is read out from the memory MM and is supplied to the comparator CP. The comparator CP compares the readout data with the output from the processing section PRS. An output from the comparator CP is generated as a double sheet detection output DO through an output circuit OC such as an AND gate.

The selector SEL generates an output when the output from the processing section PRS falls outside a predetermined range. The output from the selector SEL is supplied to the memory MM through a memory controller MC such as an OR gate, thereby preventing the memory MM from storing the output from the operation circuit OP. The output from the comparator CP is also supplied to the memory MM through the memory controller MC so as to prevent the memory MM for a similar purpose.

On the other hand, the output from the photosensor LR is also supplied to a paper detector PD using a Schmitt trigger circuit. When the output from the photosensor LR falls decreased below a predetermined level, the paper detector PD generates a signal. This signal is supplied to the output circuit OC. At the same time, a timing signal generated from a timing signal generator TSG in synchronism with the output from the detector TD is supplied to the output circuit OC. When these two signals coincide, the output circuit OC is turned on, thereby gating the output from the comparator CP.

It should be noted that the timing signal generator TSG generates various timing signals which are supplied to the processing section PRS, the subtracted value generator SNG, the memory MM and so on, thereby controlling the operation timings of the components of the double sheet detection apparatus.

A switch SW is arranged to be switched in accordance with the types of sheets 2. The switch SW controls the power supply LPS to vary the luminous intensity of the light source LG. At the same time, the switch SW controls the selector SEL and the subtracted value generator SNG so as to vary a predetermined range of the output from the processing section PRS monitored by the selector SEL and to vary a range of subtracted values Ln each represented by the output from the subtracted value generator SNG.

Figure 8:
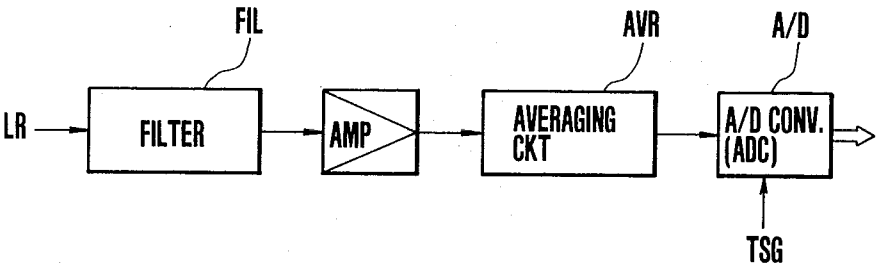
FIG. 8 is a block diagram showing the detailed arrangement of a processing section shown in FIG. 7.

FIG. 8 is a block diagram showing the detailed arrangement of the processing section PRS. The output from the photosensor LR is supplied to a filter FIL. The filter FIL removes a noise component of the output from the photosensor LR. The filtered output is amplified by an amplifier AMP to a predetermined level. The amplified output is averaged by an averaging circuit AVR including an integrator. The averaged output is converted by an analog-to-digital converter (to be referred to as an ADC hereinafter) A/D to a digital signal in response to the timing signal from the timing signal generator TSG.

Figure 9:
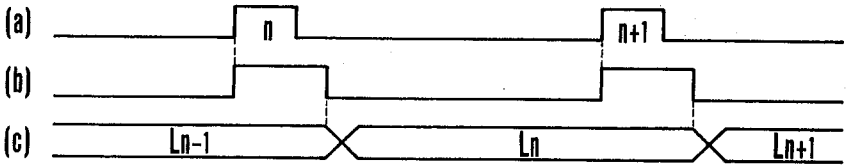
FIG. 9 is a timing chart for explaining the operation of an analog-to-digital converter and a subtracted value generator.

FIG. 9 is a timing chart for explaining the operations of the ADC A/D and the subtracted value generator SNG. The ADC A/D repeats a conversion operation (b) in response to nth and (n+1)th timing signals (a). Therefore, the subtracted value generator SNG generates subtracted values Ln and Ln+1 as indicated by a waveform (c).

The subtracted values corresponding to the amounts D of light are stored in predetermined memory areas at corresponding addresses. Upper bits of an address are accessed by the switch SW to determine the range of subtracted values. At the same time, lower bits of the address are accessed in response to the output from the ADC A/D to read out the data from the memory area at the corresponding address.

Figure 10:
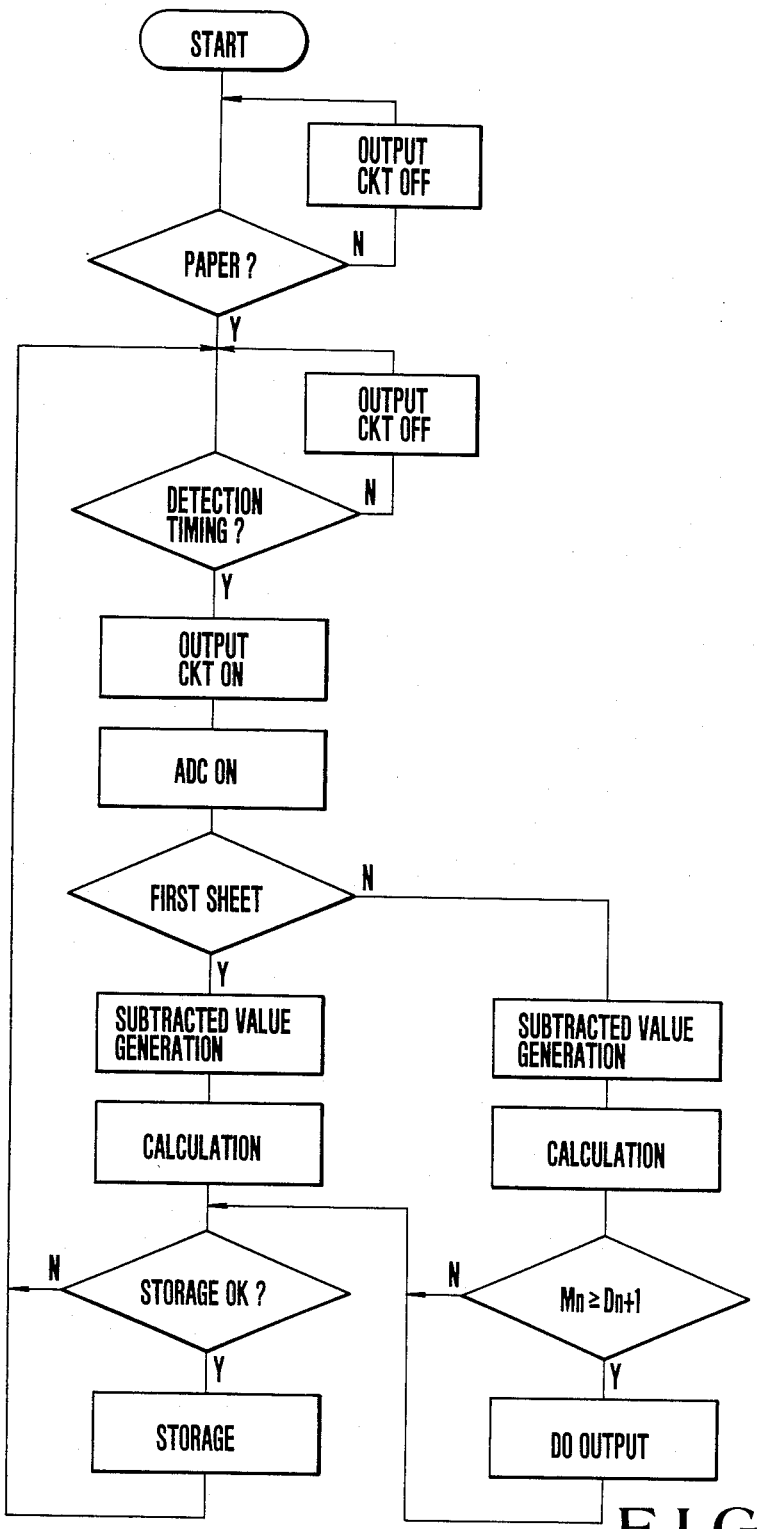
FIG. 10 is a flow chart for explaining the operation of the double sheet detection apparatus shown in FIG. 7.

FIG. 10 is a flow chart for explaining the operation of the double sheet detection apparatus shown in FIG. 7. In the step determining whether or not the paper detector PD detects that "paper is present", and in the step determining whether or not the timing signal indicates a "detection timing", if Y (YES) in these steps, the output circuit OC is turned on. Furthermore, the processing section PRS converts amount Dn of light transmitted through the sheet 2 into a digital signal to be sent out therefrom. If YES in the step determining whether or not the sheet 2 is the "first sheet", a "subtracted value" is generated from the subtracted value generator SNG. Therefore, when the amount data Dn and the subtracted value data Ln are supplied to the operation circuit OP, the operation circuit OP performs the operation "Dn−Ln". The selector SEL checks whether or not the amount Dn falls within the predetermined range. If YES in this step, YES is obtained in the step determining whether or not the amount data Dn is "capable of being stored". The reference value Mn is "stored" in the memory MM.

However, if NO in the step determining whether or not the sheet 2 is the "first sheet" (i.e., if the sheet 2 is the second or subsequent sheet), a "subtracted value" is generated. In this case, the operation circuit OP receives an amount Dn+1 and the subtracted value Ln+1, so that the operation circuit OP generates an output representing the reference value Mn+1. If YES in steps determining whether or not "Mn≧Dn+1" and the "value can be stored", the content of the memory MM is updated and stored again.

However, before the above operation, the amount data Dn+1 and the reference value Mn represented by the content of the memory MM are supplied to the comparator CP. The comparator CP compares these two data to determine whether or not "Mn≧Dn+1". If YES in this step, the detection output is generated through the output circuit OC.

In the step determining whether or not the data can be stored, the output from the comparator CP is one of the factors for this determination step. Therefore, when the condition "Mn≧Dn+1" is established and the output is generated from the comparator CP, the above determination step is checked to be NO.

If NO in the steps determining whether or not the "paper is present" and the timing pulse indicates the "detection timing", the output circuit is turned off, and an unnecessary signal will not be produced through the output circuit.

The above operation is repeated to automatically set the optimal reference values Mn in accordance with the amounts D of light transmitted through the sheets 2. Double sheet detection is then performed in accordance with a currently detected amount and its corresponding reference value. As a result, the principle shown in FIG. 4 can be properly implemented.

The detector TD may comprise a rotary encoder. The subtracted value generator SNG, the operation circuit OP, the memory MM, the comparator CP, the selector SEL and the memory controller MC may be replaced with a microprocessor and a memory. In addition to these modifications, an analog circuit may be utilized to obtain the same function as the apparatus shown in FIG. 7. Other modifications and changes may be made within the spirit and scope of the present invention.

As is apparent from the above embodiment of the present invention, the optimal reference value can be automatically updated, so the influences by a change in transmittance of the sheet and other changes in detection conditions can be eliminated, thereby providing proper double sheet detection in various types of sheet-fed rotary presses.

What is claimed is:

1. A double sheet detection method used in a sheet-fed rotary press, comprising the steps of:

setting a theoretical reference value as an intermediate value between a first theoretical amount of light transmitted through one sheet and a second theoretical amount of light transmitted through two sheets, respectively;

subtracting the theoretical reference value from the first amount of light to obtain a theoretical subtracted value;

subtracting the theoretical subtracted value from an actual amount of light transmitted through a reference sheet to obtain an actual reference value; and comparing an actual amount of light transmitted through a current sheet with the actual reference value to perform double sheet detection.

2. A method according to claim 1, wherein the theoretical reference value is approximated by lines each of which has a predetermined slope which is a functionn of the actual amount of light transmitted through one sheet and the light transmittance of said one sheet and is provided in each region of a detectable range of double sheet detection.

3. A method according to claim 1, wherein the theoretical reference value is obtained to have predetermined a low level when the sheet has a low transmittance.

4. A double sheet detection apparatus of a sheet-fed rotary press, comprising:

a light-emitting element and a light-receiving element for generating an analog signal representing an amount of light received;

a processing section for receiving the analog signal from said light-receiving element and converting the analog signal into a digital signal;

a subtracted value generator for generating a first subtracted value for a first sheet fed by said rotary press;

an operation circuit for receiving the digital signal from said processing section and the first subtracted value from said substracted value generator and substracting the first subtracted value from the digital signal to produce a second subtracted value, said second substracted value being generated by a second and each subsequent sheet fed by said rotary press;

a memory for receiving and storing the second subtracted value;

a comparator for receiving the digital signal from said processing section and the second subtracted value from said memory and comparing the digital signal with the second subtracted value; and an output circuit for receiving and gating as a double sheet detection output and output from said comparator 5. An apparatus according to claim 4, further comprising:

a timing signal generator for generating various timing signals in response to rotation of an impression cylinder of the sheet-fed rotary press; and a paper detector for generating an output when the analog signal from said light-receiving element has a level lower than a predetermined level, the output from said paper detector being supplied to said output circuit which generates the double sheet detection output in response to a corresponding one of the various timing signals generated from said timing signal generator when the output from said comparator coincides with the output from said paper detector.

6. An apparatus according to claim 4, further comprising:

a selector for generating an output when the digital signal from said processing section PRS falls outside a predetermined range; and a memory controller for receiving the output from said selector and the output from said comparator and for preventing said memory from storing the second subtracted value from said operation circuit.

7. An apparatus according to claim 4, further comprising:

a switch for changing a luminous intensity of said light-emitting element in accordance with a type of sheets and for controlling said selector and said subtracted value generator.

8. An apparatus according to claims 4 or 5, wherein said processing section comprises:

a filter for removing a noise component of the analog signal;

an amplifier for receiving a filtered output from said filter and amplifying the filtered output;

an averaging circuit for averaging an amplified output from said amplifier; and an analog-to-digital converter for converting an averaged output from said averaging circuit in response to a corresponding one of the various timing signals from said timing signal generator.

* * * * *